US011462088B2

(12) United States Patent
Sandoval et al.

(10) Patent No.: US 11,462,088 B2
(45) Date of Patent: Oct. 4, 2022

(54) SMART ANTI-THEFT TAG WITH QUADRUPLE ALARM FUNCTION

(71) Applicant: Industrial Security Solutions, Corp., Sparks, NV (US)

(72) Inventors: David Michael Sandoval, Huntington Beach, CA (US); Mingjun Hu, Hangzhou (CN)

(73) Assignee: Industrial Security Solutions, Corp., Sparks, NV (US)

( * ) Notice: Subject to any disclaimer, the term of this patent is extended or adjusted under 35 U.S.C. 154(b) by 0 days.

(21) Appl. No.: 17/345,789

(22) Filed: Jun. 11, 2021

(65) Prior Publication Data

US 2022/0207975 A1 Jun. 30, 2022

(30) Foreign Application Priority Data

Dec. 25, 2020 (CN) ..... 202023202288.0

(51) Int. Cl.
*G08B 13/24* (2006.01)
*G08B 13/14* (2006.01)

(52) U.S. Cl.
CPC ..... *G08B 13/2434* (2013.01); *G08B 13/149* (2013.01); *G08B 13/1463* (2013.01); *G08B 13/2431* (2013.01)

(58) Field of Classification Search
CPC ..... G08B 13/2434; G08B 13/1463; G08B 13/149; G08B 13/2431
See application file for complete search history.

(56) References Cited

U.S. PATENT DOCUMENTS

| | | | | |
|---|---|---|---|---|
| 7,474,209 | B2 * | 1/2009 | Marsilio | E05B 45/005 340/568.1 |
| 8,281,626 | B2 * | 10/2012 | Conti | G08B 13/2434 70/57.1 |
| 8,890,689 | B2 * | 11/2014 | Ezzo | E05B 73/0041 340/568.1 |
| 9,245,432 | B2 * | 1/2016 | Yang | G08B 13/2434 |
| 9,472,073 | B2 * | 10/2016 | Yang | G08B 13/2434 |
| 2011/0102179 | A1 | 5/2011 | Ezzo et al. | |
| 2014/0104061 | A1 | 4/2014 | Luo et al. | |

* cited by examiner

*Primary Examiner* — John A Tweel, Jr.
(74) *Attorney, Agent, or Firm* — Sheppard, Mullin, Richter & Hampton LLP

(57) ABSTRACT

Embodiments described herein relate to an anti-theft device. Some embodiments comprise a cover seat which is provided with an acoustomagnetic coil and a circuit board and formed with a guide slot, an arm hook which is a curved hook and has a long arm movably inserted into the guide slot, a plug which is mounted on the cover seat and used to lock the arm hook in a moving state, and a cable which is mounted at one end of the cover seat, penetrates through a YETI® vacuum cup and is electrically connected to the circuit board, wherein a monitoring assembly for protecting the tag against damage is mounted on the tag and comprises a Hall® switch arranged on the circuit board and magnetic steel arranged on a short arm of the arm hook.

10 Claims, 8 Drawing Sheets

--- Prior Art ---

SMART ANTI-THEFT TAG WITH QUADRUPLE ALARM FUNCTION

CROSS-REFERENCE TO RELATED APPLICATIONS

This application claims priority to Chinese Patent Application No. 202023202288.0, filed on Dec. 28, 2020, which is herein incorporated by reference for all purposes.

TECHNICAL FIELD

The invention relates to an anti-theft device, in particular to a self-alarm anti-theft tag for vacuum cups.

BACKGROUND

YETI® vacuum cups are widely used at present and have the following structural features: the upper portion is thick, the lower portion is a bit thin, a cup lid covers an opening in the upper end of a cup body through a seal ring, and a water outlet is formed in the edge of the cup lid. Users can drink water directly via the water outlet without opening the cup lid, so the YETI® vacuum cups are particularly suitable for drivers in the driving process. While these vacuum cups are popular, they may also be subject to theft which should be abated.

BRIEF SUMMARY OF EMBODIMENTS

The technical issue to be settled by the invention is to overcome the defects mentioned in the background to provide a novel smart anti-theft tag with a quadruple alarm function. The tag has a comprehensive anti-theft function.

In some embodiments, a novel smart anti-theft tag with a quadruple alarm function comprises a cover seat which is provided with an acoustomagnetic coil and a circuit board and formed with a guide slot, an arm hook which is a curved hook and has a long arm movably inserted into the guide slot, a plug which is mounted on the cover seat and used to lock the arm hook in a moving state, and a cable which is mounted at one end of the cover seat, penetrates through a YETI® vacuum cup and is electrically connected to the circuit board, wherein a monitoring assembly for protecting the tag against damage is mounted on the tag and comprises a Hall® switch arranged on the circuit board and magnetic steel arranged on a short arm of the arm hook.

The magnetic steel is fixed in a groove of the short arm by means of a magnetic steel cover.

The tag further comprises a rack buckle, two branch arms are arranged at a front end of the long arm, and the rack buckle is mounted on the branch arms to prevent the long arm from being inserted into the guide slot.

Barbs are designed at ends of the branch arms to prevent the arm hook from retreating from the guide slot.

The cover seat is formed by a top cover and a bottom cover which are buckled and fixed together, a guide slot allowing the arm hook to horizontally move therein is formed between the top cover and the bottom cover, and one end of the guide slot extends leftwards and penetrates through an outer wall of the seat cover to be communicated with the outside to form an inlet via which the arm hook is inserted into the guide slot.

The plug comprises a toothed pillar arranged in a lock hole of the top cover in a vertically sliding manner and having a bottom end engaged and matched with the long arm through a unidirectional engaging structure, a spring pressing the toothed pillar downwards from an upper end of the toothed pillar, and a plug cover pressing the spring downwards and fixed at a top opening of the lock hole.

The unidirectional engaging structure comprises a plurality of unidirectional teeth formed at a bottom end of the toothed pillar and a unidirectional rack arranged on the long arm and engaged and matched with the unidirectional teeth.

The cable is approximately in a circle shape and has two ends fixed to the cover seat and connected to the circuit board.

A power switch is further mounted in the guide slot, and a contact of the power switch protrudes out of a bottom surface of the top cover to be triggered by the arm hook.

DETAILED DESCRIPTION

Figure 7:
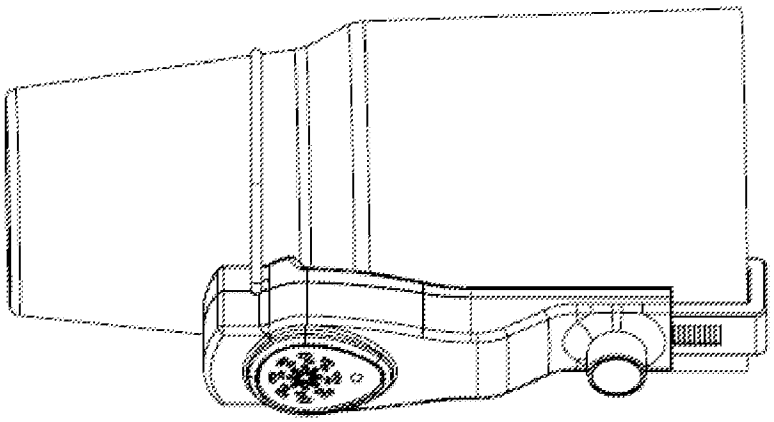
FIG. 7 is an installation diagram of the invention.

The operating principle may comprise, as shown in FIG. 7, the cable on the anti-theft tag is tied from the bottom of a YETI® vacuum cup, then the anti-theft tag is attached to the wall of the cup, and next, the arm hook is pressed downwards to enable a hook on the arm hook to be inserted into a cup lid via a water outlet in the cup lid, so the arm hook triggers the power switch in the cover seat to turn on the power switch to enable the tag to work. Although a YETI® vacuum cup is described, other cups may be used in embodiments of the disclosure.

If someone intends to steal the YETI® vacuum cup from the market without permission, the acoustomagnetic coil in the anti-theft tag will trigger an antenna at the door of the market when the shoplifter passes through the antenna, and then, the antenna gives a sound-light alarm. If the shoplifter intends to cut off the cable, a circuit in the circuit board will be triggered, and a sounder element (e.g., a buzzer) in the circuit board will give an alarm automatically. The anti-theft tag provided by the invention can be protected against damage: when someone with a malicious intension attempts to destroy the anti-theft tag or remove the tag from the vacuum cup, the distance between the anti-theft tag and the vacuum cup under protection will go beyond the protection scope, and a signal alarm will be triggered. This alarm function can deter those with malicious intensions, and can protect the commodity and the anti-theft tag against damage.

The invention has the following beneficial effects: the anti-theft tag can be protected against damage, thus having a quadruple alarm function: the alarm function of the anti-theft tag, the alarm function realized when an antenna of an anti-theft system is triggered, the alarm function in case of destruction (e.g., when the cable is cut off), and the damage-proof alarm function; and by configuring the smart anti-theft tag on the YETI® vacuum cup, the YETI® vacuum cup can be effectively prevented from being stolen when sold in a market, and the anti-theft tag is simple in structure, low in cost and popular in the industry.

The illustrated embodiment will be further explained below in conjunction with the accompanying drawings.

Figure 8:
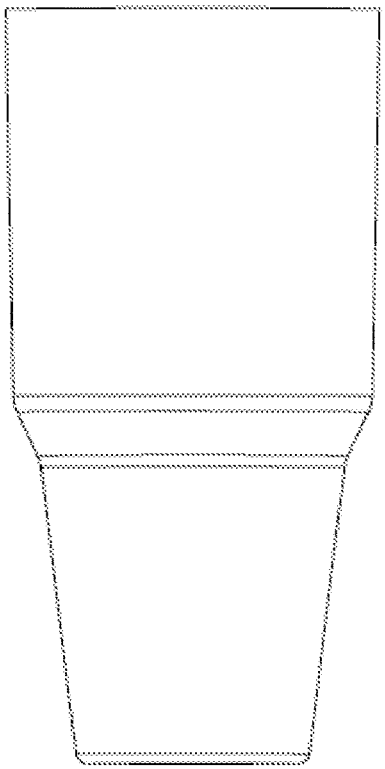
FIG. 8 is a front structural view of a YETI® vacuum cup.

A YETI® vacuum cup, as shown in FIG. 8, has a thick upper portion and a thin lower portion in structure; and a cup lid covers an opening in the upper end of a cup body through a seal ring, and a water outlet is formed in the edge of the cup lid. This is the common structure of YETI® vacuum cups.

According to a novel smart anti-theft tag with a quadruple alarm function provided by the invention, an acoustomagnetic coil 5 and a circuit board 10 are arranged on a cover seat; the cover seat is formed by a top cover 4 and a bottom cover 9 which are fixed together (e.g., with a binding agent); a guide slot allowing an arm hook 8 to horizontally move therein is formed between the top cover and the bottom cover, a left end of the guide slot extends leftwards and penetrates through an outer wall of the cover seat to be communicated with the outside to form an inlet, and the arm hook is inserted into the slot via the inlet. A power switch 17 is mounted in the guide slot, and a contact of the power switch protrudes out of a bottom surface of the top cover to be triggered by the arm hook to start a circuit, so as to enable the tag to work. The circuit board is provided with a battery 7 (e.g., model: CR2450).

The arm hook is a curved hook and has a long arm 8-1 movably inserted into the guide slot and a short arm 8-2 capable of hooking the opening of the cup lid during use to firmly fix the tag on the vacuum cup. In some embodiments, an anti-theft tag for vacuum cups can protect the cup body or the cup lid. In some embodiments, the tag provided by the disclosure can protect the cup body, and also can protect the cup lid. When the tag provided by the disclosure is used, the cup lid of the YETI® vacuum cup may be locked and not separated from the cup body, so an observer can open the cup lid by a certain angle to observe the internal structure of the cup.

A plug is mounted on the cover seat (e.g., on the top cover) and is used to lock the arm hook. In the plug, a toothed pillar 3 is located in a lock hole 4-1 of the top cover in a vertically sliding manner (e.g., the sliding direction of the toothed pillar is perpendicular to the moving direction of the arm hook, etc.), a bottom end of the toothed pillar is engaged and matched with the long arm through a unidirectional engaging structure, and a steel bar is embedded in the toothed pillar to improve the attractive force when a magnet works; a spring 2 presses the toothed pillar downwards from an upper end of the toothed pillar; and a plug cover 1 is fixed to a top opening of the lock hole and presses the spring downwards, so that a downward elastic pressing force is applied to the toothed pillar by the spring.

Figure 1:
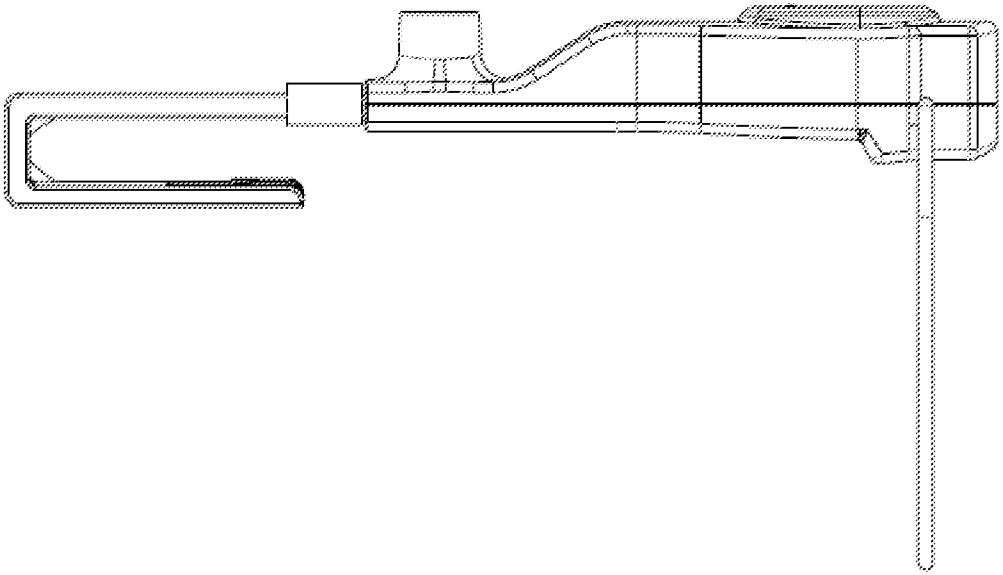
FIG. 1 is a front structural view of the invention.
Figure 2:
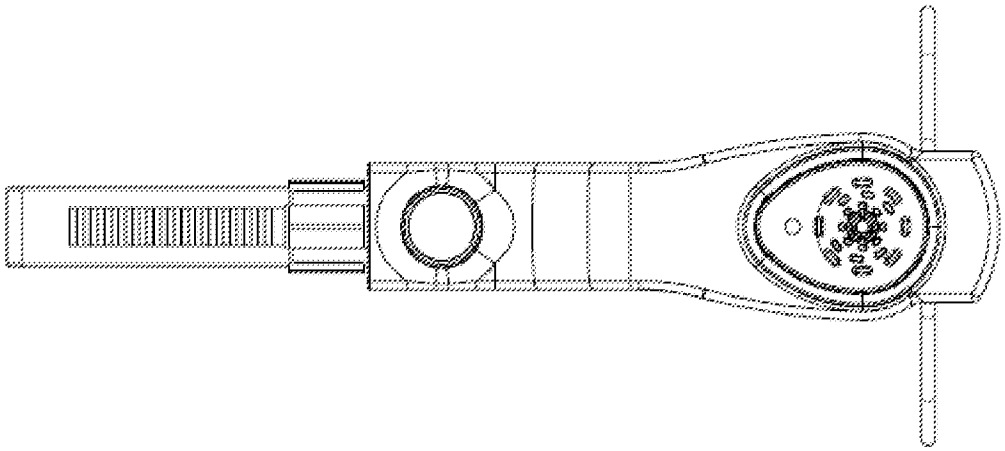
FIG. 2 is a top structural view of the invention.
Figure 3:
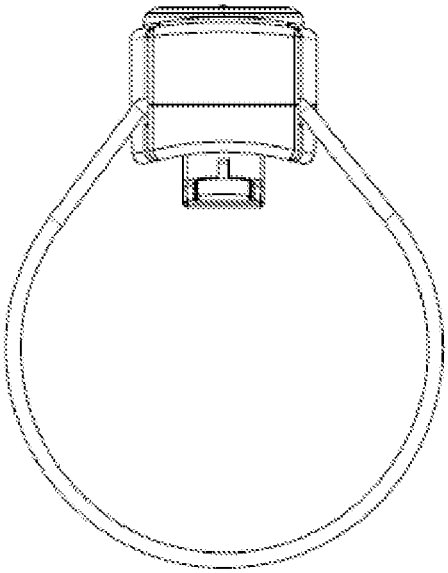
FIG. 3 is a right structural view of the invention.
Figure 4:
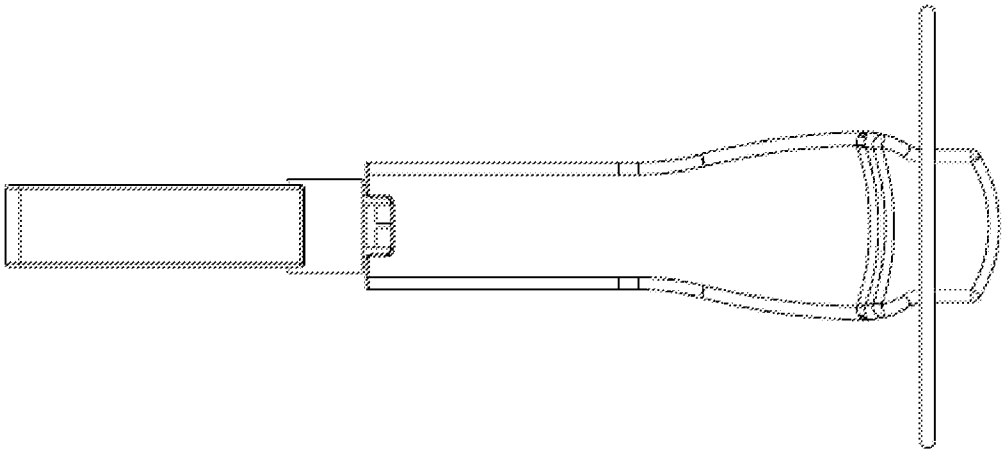
FIG. 4 is a bottom structural view of the invention.
Figure 5:
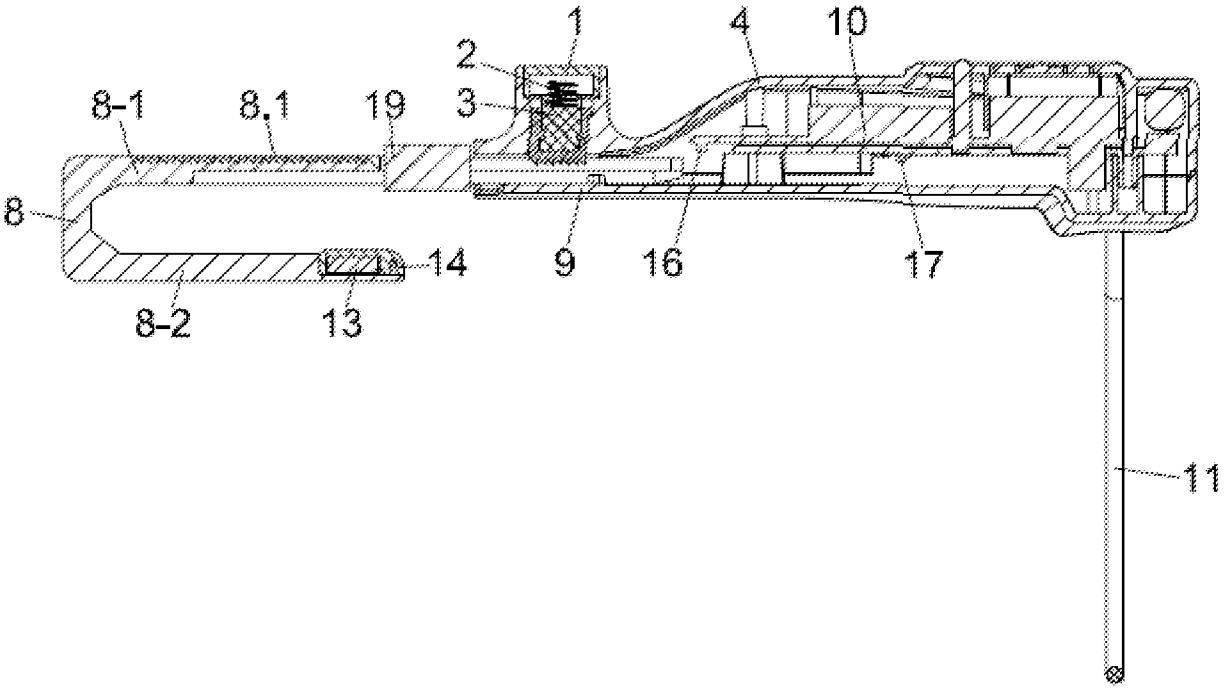
FIG. 5 is a sectional structural view of the invention.

The unidirectional engaging structure comprises a plurality of unidirectional teeth formed at a bottom end of the toothed pillar and a unidirectional rack 8.1 arranged on the long arm; and the unidirectional rack is engaged and matched with the unidirectional teeth, such that the arm hook can move in one direction (e.g., the arm hook can move in the guide slot from left to right in FIG. 1, FIG. 2, and FIG. 4).

A cable 11 is mounted at one end of the cover seat (e.g., at the right end, as shown in FIG. 1), penetrates through the YETI® vacuum cup and is used as a wire electrically connected to the circuit board. The cable is approximately in a circle shape, and both ends of the cable are fixed to the cover seat and are connected to the circuit board.

The improvement of the invention lies in that a monitoring assembly for protecting the tag against damage is mounted on the tag. In the monitoring assembly, a Hall® switch 16 is arranged on the circuit board, and magnetic steel 13 is arranged on the short arm. A groove 8.2 is formed in a side, facing the long arm, of the end of the short arm, and the magnetic steel is disposed in the groove and is fixed by means of a magnetic steel cover 14. When the arm hook is inserted into the guide slot, the magnetic steel is close to the Hall® switch and is located within the sensing range of the Hall® switch.

Figure 6:
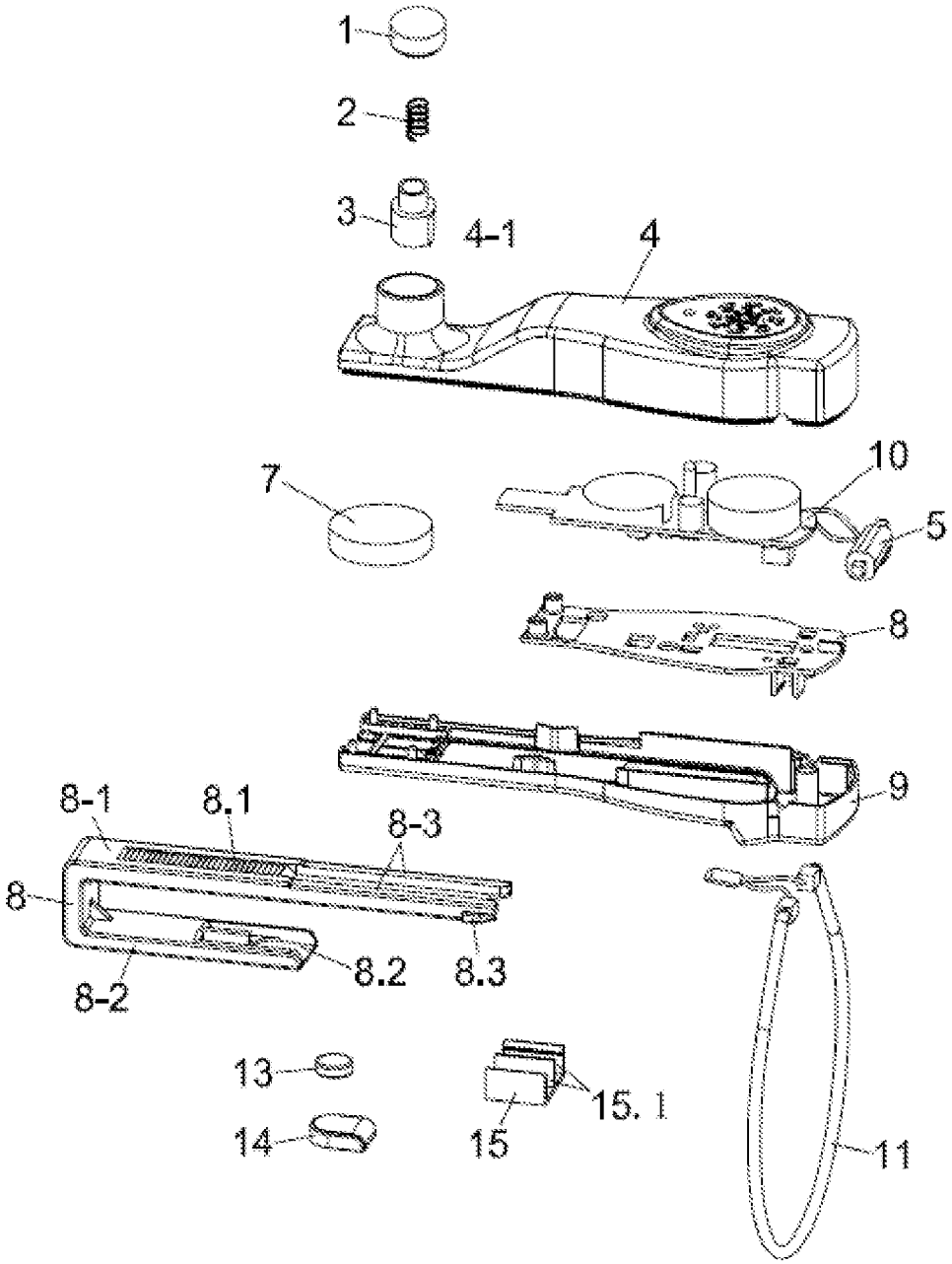
FIG. 6 is an exploded view of the invention.

Two branch arms 8-3 are arranged at a front end of the long arm (e.g., a right end of the long arm in FIG. 2) in parallel and are spaced apart from each other by a certain distance, and barbs 8.3 are designed at ends of the branch arms to prevent the branch arms from retreating from the guide slot. As shown in FIG. 6, barbs protruding outwards are formed on left and right sides of the end of each branch arm and are hooked in holes in left and right walls of the guide slot, so that the branch arms are prevented from retreating from the guide slot.

The tag further comprises a rack buckle 15, two clamping grooves 15.1 matched with the branch arms are formed in the rack buckle 15, and the rack buckle can be inserted in the branch arms (e.g., as shown in FIG. 1), so that the arm hook can be prevented from being inserted into the guide slot, which may otherwise cause accidental locking.

When the smart anti-theft tag is locked, the power switch will be turned on, the magnetic steel is within the sensing range of the Hall® switch, and the tag will not give an alarm. When a shoplifter intends to steal the vacuum cup with the tag, he/she has to break off the cup lid, which will in turn drive the magnetic steel to move with respect to the Hall® switch; when the magnetic steel moves out of the sensing range of the Hall® switch, a pre-alarm will be given to frighten the shoplifter from stealing the vacuum cup, the pre-alarm will last for three seconds, and if the cup lid is returned, that is the rack is returned, within the three seconds, the pre-alarm will stop. If the theft still commits shoplifting regardless of the pre-alarm sounds, a formal alarm will be given once the pre-alarm lasts for over three seconds, and the formal alarm is irreversible and will not be eliminated unless the tag is reassembled on the vacuum cup.

This alarm function can deter the shoplifter, and may also protect the commodity and the smart anti-theft tag against damage.

We claim:

1. A novel smart anti-theft tag with a quadruple alarm function, comprising:

a cover seat which is provided with an acoustomagnetic coil and a circuit board and formed with a guide slot;

an arm hook which is a curved hook and has a long arm movably inserted into the guide slot;

a plug which is mounted on the cover seat and used to lock the arm hook in a moving state; and a cable which is mounted at one end of the cover seat, penetrates through a vacuum cup and is electrically connected to the circuit board, wherein a monitoring assembly for protecting the tag against damage is mounted on the tag and comprises a switch arranged on the circuit board and magnetic steel arranged on a short arm of the arm hook.

2. The novel smart anti-theft tag with a quadruple alarm function according to claim 1, wherein the magnetic steel is fixed in a groove of the short arm by means of a magnetic steel cover.

3. The novel smart anti-theft tag with a quadruple alarm function according to claim 2, further comprising a rack buckle, wherein two branch arms are arranged at a front end of the long arm, and the rack buckle is mounted on the branch arms to prevent the long arm from being inserted into the guide slot.

4. The novel smart anti-theft tag with a quadruple alarm function according to claim 3, wherein barbs are designed at ends of the branch arms to prevent the arm hook from retreating from the guide slot.

5. The novel smart anti-theft tag with a quadruple alarm function according to claim 1, wherein the cover seat is formed by a top cover and a bottom cover which are buckled and fixed together, a guide slot allowing the arm hook to horizontally move therein is formed between the top cover and the bottom cover, and one end of the guide slot extends leftwards and penetrates through an outer wall of the seat cover to be communicated with an outside to form an inlet via which the arm hook is inserted into the guide slot.

6. The novel smart anti-theft tag with a quadruple alarm function according to claim 4, wherein the cover seat is formed by a top cover and a bottom cover which are buckled and fixed together, a guide slot allowing the arm hook to horizontally move therein is formed between the top cover and the bottom cover, and one end of the guide slot extends leftwards and penetrates through an outer wall of the seat cover to be communicated with an outside to form an inlet via which the arm hook is inserted into the guide slot.

7. The novel smart anti-theft tag with a quadruple alarm function according to claim 6, wherein the plug comprises a toothed pillar located in a lock hole of the top cover in a vertically sliding manner and having a bottom end engaged and matched with the long arm through a unidirectional engaging structure, a spring pressing the toothed pillar downwards from an upper end of the toothed pillar, and a plug cover pressing the spring downwards and fixed to a top opening of the lock hole.

8. The novel smart anti-theft tag with a quadruple alarm function according to claim 7, wherein the unidirectional engaging structure comprises a plurality of unidirectional teeth formed at a bottom end of the toothed pillar and a unidirectional rack arranged on the long arm and engaged and matched with the unidirectional teeth.

9. The novel smart anti-theft tag with a quadruple alarm function according to claim 8, wherein the cable is approximately in a circle shape and has two ends fixed to the cover seat and connected to the circuit board.

10. The novel smart anti-theft tag with a quadruple alarm function according to claim 9, wherein a power switch is further mounted in the guide slot, and a contact of the power switch protrudes out of a bottom surface of the top cover to be triggered by the arm hook.

* * * * *